US005934253A

United States Patent [19]

Kojima et al.

[11] Patent Number: 5,934,253

[45] Date of Patent: Aug. 10, 1999

[54] FUEL INJECTION APPARATUS

[75] Inventors: Susumu Kojima, Susono; Keiso Takeda, Mishima, both of Japan

[73] Assignee: Toyota Jidosha Kabushiki Kaisha, Aichi-Ken, Japan

[21] Appl. No.: 08/975,425

[22] Filed: Nov. 20, 1997

[30] Foreign Application Priority Data

Dec. 24, 1996 [JP] Japan ..... 8-344083
Jul. 16, 1997 [JP] Japan ..... 9-191616

[51] Int. Cl.[6] ..... F02M 55/02

[52] U.S. Cl. ..... 123/470; 123/469

[58] Field of Search ..... 123/470, 468, 123/456, 472, 469, 471; 239/600

[56] References Cited

U.S. PATENT DOCUMENTS

| | | | |
|---|---|---|---|
| 4,860,910 | 8/1989 | Hafner | 123/468 |
| 4,950,171 | 8/1990 | Muzslay | 123/470 |
| 4,979,295 | 12/1990 | Stagni | 123/470 |
| 5,016,594 | 5/1991 | Hafner | 123/470 |
| 5,038,738 | 8/1991 | Hafner | 123/468 |
| 5,299,542 | 4/1994 | Hafner | 123/470 |
| 5,577,480 | 11/1996 | Gmelin | 123/470 |
| 5,598,824 | 2/1997 | Treusch | 123/470 |
| 5,630,400 | 5/1997 | Sumida | 123/470 |
| 5,735,247 | 4/1998 | Tsuzuki | 123/468 |

FOREIGN PATENT DOCUMENTS

| | | |
|---|---|---|
| 6505080 | 6/1994 | Japan . |
| 7197873 | 8/1995 | Japan . |
| 7224738 | 8/1995 | Japan . |
| 828396 | 1/1996 | Japan . |
| 882268 | 3/1996 | Japan . |
| 8189441 | 7/1996 | Japan . |
| 8284779 | 10/1996 | Japan . |
| 8334075 | 12/1996 | Japan . |

*Primary Examiner*—Carl S. Miller
*Attorney, Agent, or Firm*—Kenyon & Kenyon

[57] ABSTRACT

A fuel injection apparatus has a delivery pipe 7, an injector 8, fixing hooks 56 and fixing hook grooves 38. The delivery pipe 7 has an electric signal line and a connector 34, the connector 34 being placed at an end of the electric signal line. The injector 8 has an O-ring 52 and an injector side terminal 54 and is mounted to the delivery pipe 7, the O-ring 52 having a center P and sealing a gap between the delivery pipe 7 and the injector 8. The injector side terminal 54 is electrically connected with the connector 34. The fixing hooks 56 and the fixing hook grooves 38 prevent the injector side terminal 54 from sliding with respect to the connector 34 in the direction of an axis of the injector 8. The contacting points between the fixing hooks 56 and the fixing hook grooves 38 are positioned on a line L. The line L passes through the center P of the O-ring 52 and is perpendicular to the axis of the injector 8.

7 Claims, 15 Drawing Sheets

FUEL INJECTION APPARATUS

BACKGROUND OF THE INVENTION

1. Field of the Invention

The present invention relates to a fuel injection apparatus and particularly relates to a fuel injection apparatus for preventing an injector from moving with respect to an integrated delivery pipe in the direction of an axis of the injector, for preventing an injector side terminal from sliding with respect to a connector provided in the delivery pipe, and for preventing the decrease of sealing efficiency of fuel between the delivery pipe and the injector even if the injector is inclined with respect to the delivery pipe and is mounted to the delivery pipe.

2. Description of the Related Art

As is known in the prior art, a fuel injection apparatus has a fixing hook for preventing an injector from moving with respect to an integrated delivery pipe in a direction of an axis of the injector, and for preventing an injector side terminal from sliding with respect to a connector provided in the delivery pipe. FIG. 15 is an enlarged partial sectional view of the delivery pipe and the injector of the fuel injection apparatus of the prior art. In FIG. 15, a reference numeral 100 shows the delivery pipe molded with resin material, for connecting a fuel pump and each injector for each cylinder. A reference numeral 102 shows a delivery pipe side terminal of an electric signal line transmitting an electric signal for driving the injector. A reference numeral 104 shows a connector. A reference numeral 106 shows an injector mounting hole. A reference numeral 108 shows a fixing hook groove. A reference numeral 120 shows the injector for injecting and supplying fuel to an intake manifold 140, a valve of the injector being electrically opened or closed. A reference numeral 122 shows an O-ring for sealing a gap between the injector mounting hole 106 and the injector 120. A reference numeral 124 shows the injector side terminal. The electric signal for driving the injector is transmitted from the electric signal line of the delivery pipe to the injector 120 via the delivery pipe side terminal 102, the connector 104 and the injector side terminal 124. A reference numeral 126 shows a fixing hook for fitting in the fixing hook groove 108. A reference numeral 128 shows an insulator for sealing a gap between an injector inserting hole 142 and the injector 120.

As shown in FIG. 15, an upper end of the injector 120 is held in the injector mounting hole 106 of the delivery pipe 100 via the O-ring 122. A lower end of the injector 120 is held in the injector inserting hole 142 of the intake manifold 140 via the insulator 128. While fuel is injected, the injector 120 is forced downwardly by fuel pressure. However, the injector 120 is prevented from moving with respect to the delivery pipe 100 in the direction of the axis of the injector, because a lower face of the fixing hook 126 contacts a lower face of the fixing hook groove 108. Therefore, the sliding of an electrically contacting point between the connector 104 and the injector side terminal 124 is prevented, and the increase of electric resistance caused by the wear of the electrically contacting point is prevented. Japanese Unexamined Patent Publication (Kokai) No. 7-224738 discloses the above mentioned fuel injection apparatus.

When the pitch of the injector mounting holes 106 and the pitch of the injector inserting holes 142 are not the same, or when an axis of the injector mounting hole 106 is inclined with respect to an axis of the injector inserting hole 142 even if the pitch of the injector mounting holes 106 and the pitch of the injector inserting holes 142 are the same, the injector 120 is inclined with respect to the axis of the injector mounting hole 106 and is mounted in the injector mounting hole 106. In the fuel injection apparatus disclosed in Japanese Unexamined Patent Publication (Kokai) No. 7-224738, since the injector 120 is held at three points by means of the O-ring 122, the fixing hook 126 and the insulator 128, the injector 120 rotates around the fixing hook 126.

FIG. 16 an enlarged partial sectional view similar to FIG. 15, wherein the injector 120 is inclined with respect to the axis of the injector mounting hole 106 and is mounted in the injector mounting hole 106. As shown in FIG. 16, when the injector 120 is inclined with respect to the axis of the injector mounting hole 106 and is mounted in the injector mounting hole 106, an upper face of the left fixing hook 126 of the injector 120 contacts an upper face of the left fixing hook groove 108 of the delivery pipe 100, and the injector 120 rotates around a contacting point between the upper face of the left fixing hook 126 and the upper face of the left fixing hook groove 108. In this case, the O-ring 122 is biased, and contacting area between the O-ring 122 and the injector mounting hole 106 decreases, and therefore, sealing efficiency of fuel between the delivery pipe 100 and the injector 120 decreases.

SUMMARY OF THE INVENTION

An object of the present invention is to provide a fuel injection apparatus for preventing an injector from moving with respect to an integrated delivery pipe in a direction of an axis of the injector, for preventing an injector side terminal from sliding with respect to a connector provided in the delivery pipe, and for preventing the decrease of sealing efficiency of fuel between the delivery pipe and the injector even if the injector is inclined with respect to the delivery pipe and is mounted to the delivery pipe.

The present invention provides a fuel injection apparatus comprising:

a delivery pipe having an electric signal line and a connector, the connector being placed at an end of the electric signal line;

an injector having an axis, an O-ring and an injector side terminal and mounted to the delivery pipe, the O-ring having a center and sealing a gap between the delivery pipe and the injector, the injector side terminal being electrically connected with the connector;

a fixing member for preventing the injector side terminal from sliding with respect to the connector in a direction of the axis of the injector; and the fixing member having a plurality of fixing points, the plurality of fixing points being positioned on a line, the line passing through the center of the O-ring and being perpendicular to the axis of the injector.

In the fuel injection apparatus, the injector side terminal does not slide with respect to the connector in the direction of the axis of the injector. When the injector is inclined with respect to the delivery pipe and is mounted to the delivery pipe, the injector rotates around the line, on which the plurality of fixing points are positioned. This means that the injector rotates around the center of the O-ring, and therefore, the contacting area between the O-ring and the delivery pipe decreases less, and a decrease in sealing efficiency of fuel between the delivery pipe and the injector can be prevented.

The present invention provides a fuel injection apparatus comprising:

a delivery pipe having an electric signal line and a connector, the connector being placed at an end of the electric signal line;

an injector having an axis, an O-ring and an injector side terminal and mounted to the delivery pipe, the O-ring having a center and sealing a gap between the delivery pipe and the injector, the injector side terminal being electrically connected with the connector;

a fixing member for preventing the injector side terminal from sliding with respect to the connector in a direction of the axis of the injector; and the fixing member having a sliding surface between the delivery pipe and the injector, the sliding surface being spherical and having a center, the center of the sliding surface corresponding to the center of the O-ring.

In the fuel injection apparatus, the injector side terminal does not slide with respect to the connector in the direction of the axis of the injector. When the injector is inclined with respect to the delivery pipe and is mounted to the delivery pipe, the fixing member slides along the spherical sliding surface, the center of the sliding surface corresponding to the center of the O-ring. This means that the injector rotates around the center of the O-ring, and therefore, contacting area between the O-ring and the delivery pipe decreases less, and a decrease in sealing efficiency of fuel between the delivery pipe and the injector can be prevented.

The present invention provides a fuel injection apparatus comprising:

a delivery pipe having an electric signal line and a connector, the connector being placed at an end of the electric signal line;

an injector having an axis, an O-ring and an injector side terminal and mounted to the delivery pipe, the O-ring having a center and sealing a gap between the delivery pipe and the injector, the injector side terminal being electrically connected with the connector;

a fixing member for preventing the injector side terminal from sliding with respect to the connector in a direction of the axis of the injector; and the fixing member being positioned on the center of the O-ring.

In the fuel injection apparatus, the injector side terminal does not slide with respect to the connector in the direction of the axis of the injector. When the injector is inclined with respect to the delivery pipe and is mounted to the delivery pipe, the injector rotates around the fixing member with respect to the delivery pipe. This means that the injector rotates around the center of the O-ring, and therefore, the contacting area between the O-ring and the delivery pipe decreases less, and a decrease of sealing efficiency of fuel between the delivery pipe and the injector can be prevented.

The present invention provides a fuel injection apparatus comprising:

a delivery pipe having an electric signal line and a connector, the connector being placed at an end of the electric signal line;

an injector having an axis, an O-ring and an injector side terminal and mounted to the delivery pipe, the O-ring having a center and sealing a gap between the delivery pipe and the injector, the injector side terminal being electrically connected with the connector;

a fixing member for preventing the injector side terminal from sliding with respect to the connector in a direction of the axis of the injector; and the delivery pipe having a sealing surface between the delivery pipe and the O-ring, the sealing surface being spherical and having a center, the center of the sealing surface corresponding to the center of the O-ring.

In the fuel injection apparatus, the injector side terminal does not slide with respect to the connector in the direction of the axis of the injector. When the injector is inclined with respect to the delivery pipe and is mounted to the delivery pipe, the O-ring slides along the spherical sealing surface, the center of the sealing surface corresponding to the center of the O-ring. This means that the injector rotates around the center of the O-ring, and therefore, the contacting area between the O-ring and the delivery pipe decreases less, and a decrease in sealing efficiency of fuel between the delivery pipe and the injector can be prevented.

The present invention provides a fuel injection apparatus comprising:

a delivery pipe having an electric signal line and a connector, the connector being placed at an end of the electric signal line;

an injector having an axis, an O-ring and an injector side terminal and mounted to the delivery pipe, the O-ring having a center and sealing a gap between the delivery pipe and the injector, the injector side terminal being electrically connected with the connector;

a fixing member for preventing the injector side terminal from sliding with respect to the connector in a direction of the axis of the injector; and the injector having an O-ring groove and an adjacent portion, the O-ring being mounted in the O-ring groove, the adjacent portion adjoining the O-ring groove and having a guide portion, the guide portion being spherical and having a center, the center of the guide portion corresponding to the center of the O-ring.

In the fuel injection apparatus, when the injector is inclined with respect to the delivery pipe and is mounted to the delivery pipe, the guide portion prevents the O-ring from being biased. This means that the injector smoothly rotates around the center of the O-ring, and therefore, the contacting area between the O-ring and the delivery pipe decreases less, and a decrease in sealing efficiency of fuel between the delivery pipe and the injector can be prevented.

The present invention provides a fuel injection apparatus comprising:

a delivery pipe having an electric signal line and a connector, the connector being placed at an end of the electric signal line;

an injector having an axis, an O-ring and an injector side terminal and mounted to the delivery pipe, the O-ring having a center and sealing a gap between the delivery pipe and the injector, the injector side terminal being electrically connected with the connector;

an engine side member, the delivery pipe and the injector being mounted to the engine side member;

a connector waterproof packing for preventing water from leaking in the connector, the connector waterproof packing being provided between the delivery pipe and the injector;

a fixing member for preventing the injector side terminal from sliding with respect to the connector in the direction of the axis of the injector;

the fixing member having a contact surface and a support surface, the contact surface being a portion of the injector, the support surface being a portion of the engine side member and contacting the contact surface;

the inclination of the injector with respect to the delivery pipe in a diametrical direction being restricted only by means of the connector waterproof packing and the O-ring.

In the fuel injection apparatus, the injector side terminal does not slide with respect to the connector in the direction of the axis of the injector. When the injector is inclined with respect to the delivery pipe and is mounted to the delivery pipe, the injector rotates around the center of the O-ring, and therefore, the contacting area between the O-ring and the delivery pipe decreases less, and a decrease in sealing efficiency of fuel between the delivery pipe and the injector can be prevented.

Preferably, the fixing member includes the connector waterproof packing, the connector waterproof packing being positioned at a boundary between the injector, the delivery pipe and the engine side member. Therefore, the connector waterproof packing can seal a gap between the injector and the delivery pipe, and can also seal a gap between the delivery pipe and the engine side member.

BRIEF DESCRIPTION OF THE DRAWINGS

The above and other objects, features and advantages of the present invention will be made more apparent from the following description of the preferred embodiments thereof in conjunction with the accompanying drawings wherein.

DESCRIPTION OF THE PREFERRED EMBODIMENTS

Figure 1:
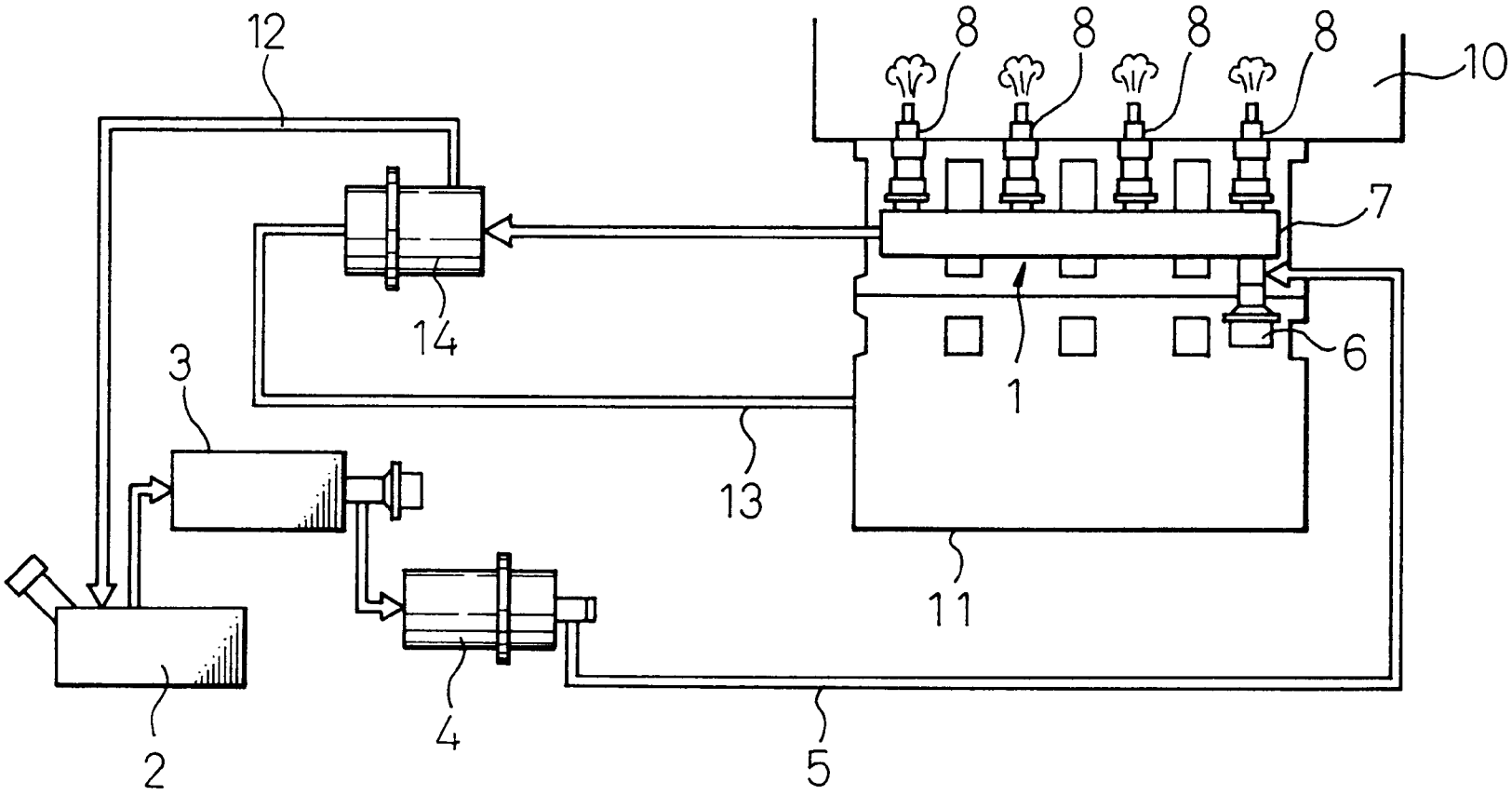
FIG. 1 is a diagrammatic view of a fuel injection system provided with a fuel injection apparatus of a first embodiment according to the present invention.

FIG. 1 shows a diagrammatic view of a fuel injection system provided with a fuel injection apparatus of a first embodiment according to the present invention. In FIG. 1, a reference numeral 1 shows the fuel injection apparatus. A reference numeral 2 shows a fuel tank. A reference numeral 3 shows a fuel pump. A reference numeral 4 shows a fuel filter. A reference numeral 5 shows a fuel supply pipe. A reference numeral 6 shows a pulsation damper. A reference numeral 7 shows a delivery pipe. A reference numeral 8 shows an injector. A reference numeral 10 shows an intake manifold. A reference numeral 11 shows a surge tank. A reference numeral 12 shows a recirculation pipe. A reference numeral 13 shows a pressure introducing pipe. A reference numeral 14 shows a pressure regulator.

Fuel stored in the fuel tank 2 is pressurized by the fuel pump 3, and is supplied to the fuel injection apparatus 1 via the fuel filter 4, the fuel supply pipe 5 and the pulsation damper 6. The fuel filter 4 removes dust contained in the fuel. The pulsation damper 6 attenuates the pulsations in fuel pressure, the pulsation occurring in the fuel supply pipe 5.

As explained below, the fuel injection apparatus 1 has the delivery pipe 7 and the plurality of injectors 8. (The number of the injectors is four in this embodiment.) The fuel supply pipe 5 is connected to the delivery pipe 7. The fuel which is pressurized and fed is introduced into a fuel path formed in the delivery pipe 7. The injector 8 is mounted to the delivery pipe 7, and opens or closes a valve, on the basis of a fuel injection electric signal transmitted from a microcomputer, for injecting the fuel into the intake manifold 10. The intake manifold 10 is connected to the surge tank 11 which decreases the pulsations in the intake air. The injected fuel is mixed with air introduced from the surge tank 11, and is drawn into the combustion chambers.

The pressure regulator 14 is connected to the delivery pipe 7. The pressure in the intake manifold 10 is introduced to the pressure regulator 14 via the pressure introducing pipe 13 connected to the surge tank 11. The pressure regulator 14 regulates the fuel pressure in the fuel path in order that the ratio of the fuel pressure in the fuel path to the pressure in the intake manifold 10 is constant. The pressure regulator 14 transports fuel which was not injected from the injectors 8, to the recirculation pipe 12 for recirculating the fuel to the fuel tank 2.

Figure 2:
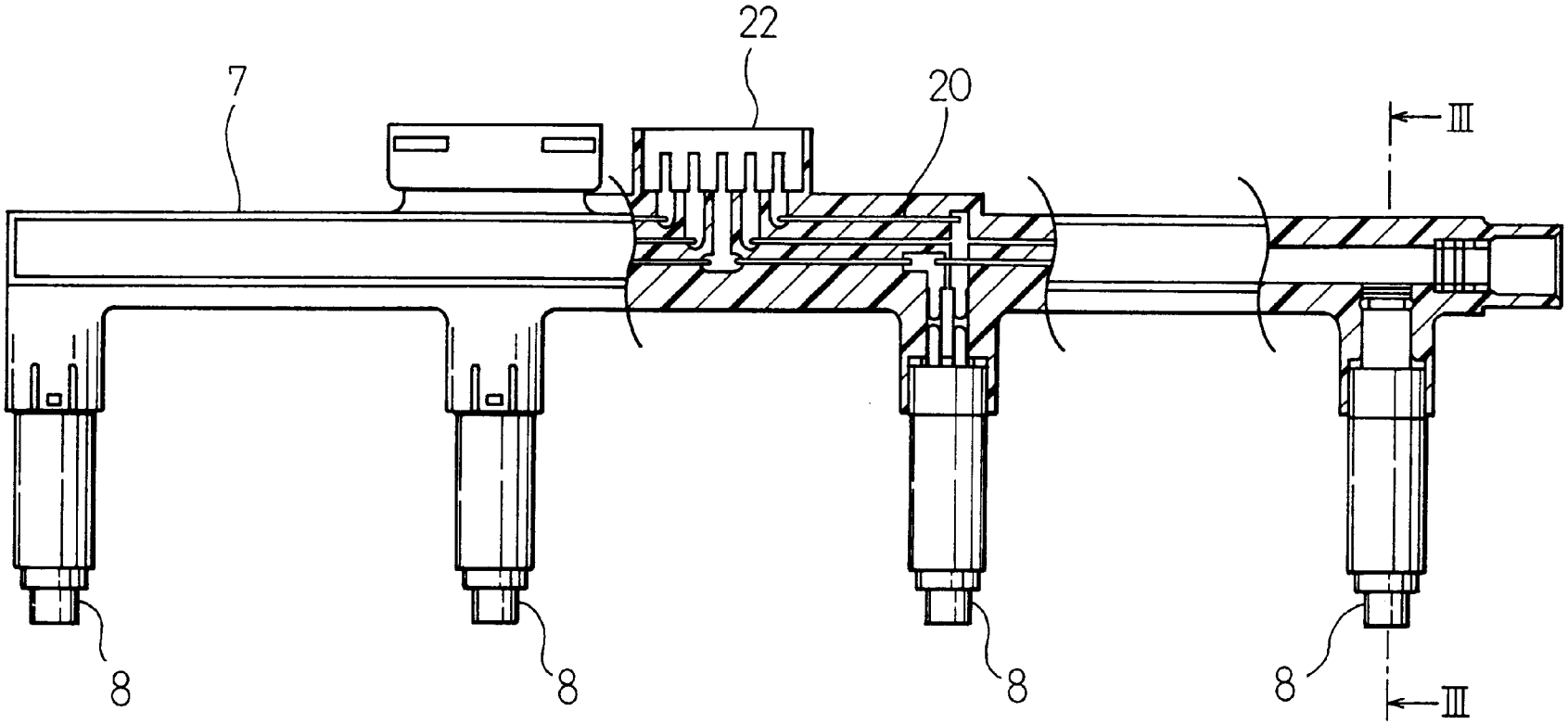
FIG. 2 is an enlarged partial sectional view of the fuel injection apparatus of the first embodiment in FIG. 1.

FIG. 2 shows an enlarged partial sectional view of the fuel injection apparatus of the first embodiment in FIG. 1. As shown in FIG. 2, the fuel injection apparatus 1 has the delivery pipe 7 and the four injectors 8. A reference numeral 20 shows an electric signal line. A reference numeral 22 shows an integrated connector. The delivery pipe 7 is an integrated delivery pipe which is molded from resin material and has the electric signal line 20 and the integrated connector 22. The electric signal line 20 transmitting an electric signal, for driving the injector 8, is housed in the delivery pipe 7 while the delivery pipe 7 is molded. One end of the electric signal line 20 is connected to the integrated connector 22, and the other end of the electric signal line 20 is connected to a connector explained below.

Figure 3:
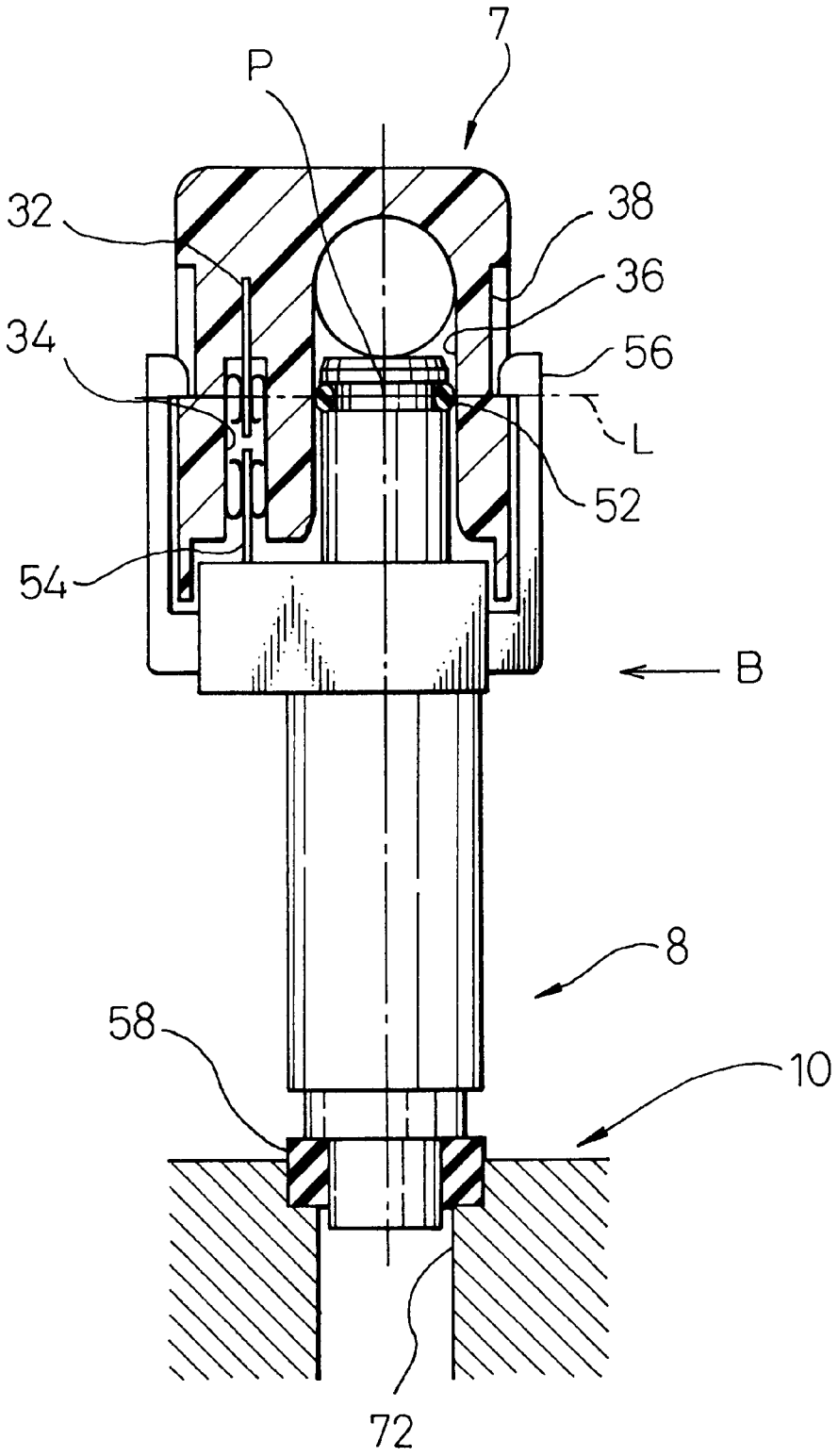
FIG. 3 is an enlarged partial sectional view of a delivery pipe and an injector cut along line III—III in FIG. 2.

FIG. 3 shows an enlarged partial sectional view of the delivery pipe and the injector cut along line III—III in FIG.

2. In FIG. 3, a reference numeral 32 shows a delivery pipe side terminal. A reference numeral 34 shows the connector made of conductive metal which has a spring property. A reference numeral 36 shows an injector mounting hole provided in the delivery pipe 7. A reference numeral 38 shows a fixing hook groove. A reference numeral 52 shows an O-ring. A reference numeral 54 shows an injector side terminal. A reference numeral 56 shows a fixing hook for fitting in the fixing hook groove 38. A reference numeral 58 shows an insulator. A reference numeral 72 shows an injector inserting hole provided in the intake manifold 10.

The delivery pipe side terminal 32 extends from the electric signal line 20 shown in FIG. 2, and transmits an electric signal for driving the injector 8. The electric signal is transmitted from the electric signal line 20 to the injector 8 via the delivery pipe side terminal 32, the connector 34 and the injector side terminal 54. When the injector 8 is mounted to the delivery pipe 7, the injector 8 is mounted in the injector mounting hole 36. At that time, the injector side terminal 54 is electrically connected to the connector 34. The O-ring 52 is positioned between the injector mounting hole 36 and the injector 8, and seals a gap between the injector mounting hole 36 and the injector 8. The insulator 58 is positioned between the injector inserting hole 72 and the injector 8, and seals a gap between the injector inserting hole 72 and the injector 8.

While fuel is injected, the injector 8 is forced downwardly by fuel pressure. However, the injector 8 is prevented from moving with respect to the delivery pipe 7 in the direction of the axis of the injector, because lower faces of the fixing hooks 56 contact lower faces of the fixing hook grooves 38. Therefore, the sliding of an electrically contacting point between the connector 34 and the injector side terminal 54 is prevented, and the increase of electric resistance caused by the wear of the electrically contacting point is prevented.

Figure 4:
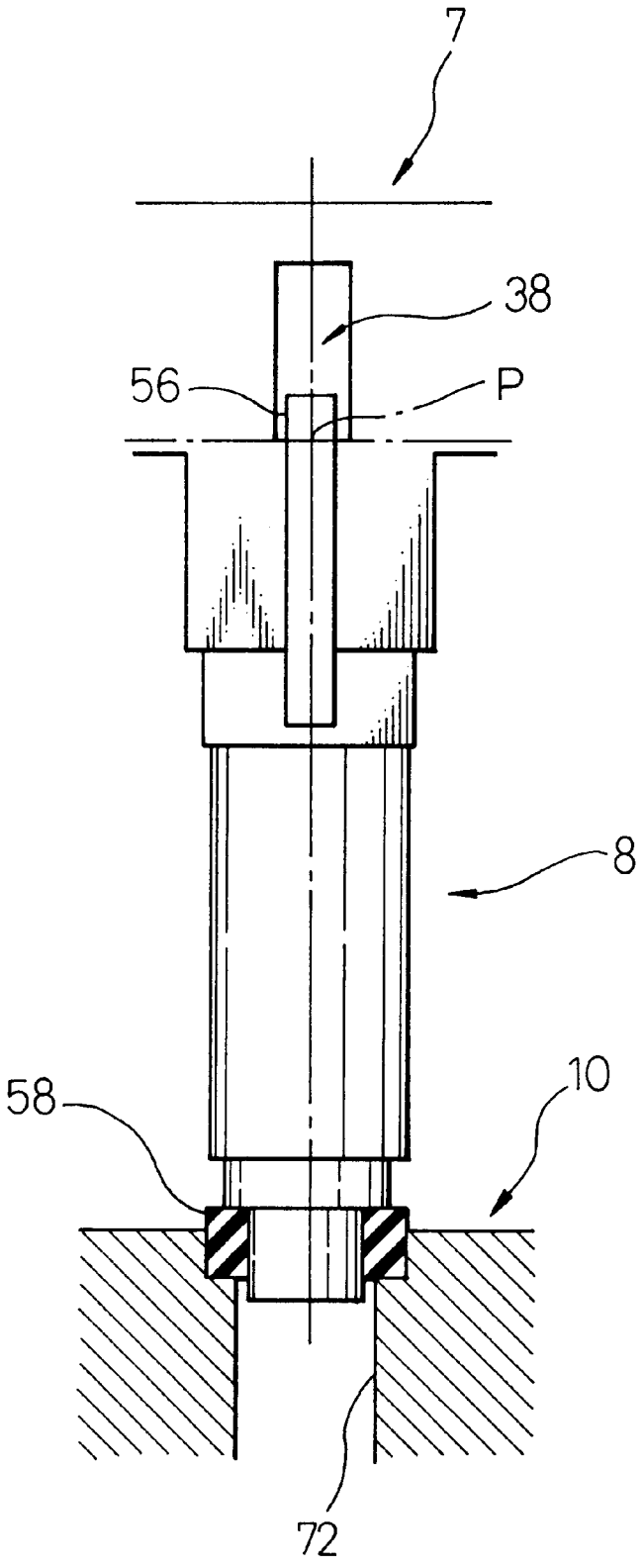
FIG. 4 is a side view of the delivery pipe and the injector viewed in a direction B in FIG. 3.

Further, as shown in FIG. 3, the lower faces of the fixing hooks 56 contact lower faces of the fixing hook grooves 38 at two points. The fixing points on which the fixing hooks 56 contact the fixing hook grooves 38, is positioned on a line L, the line L passing through a center P of an external diameter of the O-ring 52 and being perpendicular to the axis of the injector 8. Therefore, the injector 8 can rotate forwardly and backwardly (FIG. 3) with respect to the delivery pipe 7 around the line L, i.e., around the center P of the O-ring 52. FIG. 4 shows a side view of the delivery pipe and the injector viewed in a direction B in FIG. 3. In FIG. 4, the injector 8 can rotate with respect to the delivery pipe 7 around the center P of the O-ring.

When the pitch of the injector mounting holes 36 and the pitch of the injector inserting holes 72 are not the same, or when an axis of the injector mounting hole 36 is inclined with respect to an axis of the injector inserting hole 72 even if the pitch of the injector mounting holes 36 and the pitch of the injector inserting holes 72 are the same, the injector 8 is inclined (forwardly and backwardly in FIG. 3, or right and left in FIG. 4) with respect to the axis of the injector mounting hole 36 and is mounted in the injector mounting hole 36. However, since the injector 8 rotates around the line L, i.e., around the center P of the O-ring, the O-ring 52 is prevented from being biased, and contacting area between the O-ring 52 and the injector mounting hole 36 decreases less. This means that a decrease in sealing efficiency of fuel between the delivery pipe 7 and the injector 8 can be prevented.

Figure 5:
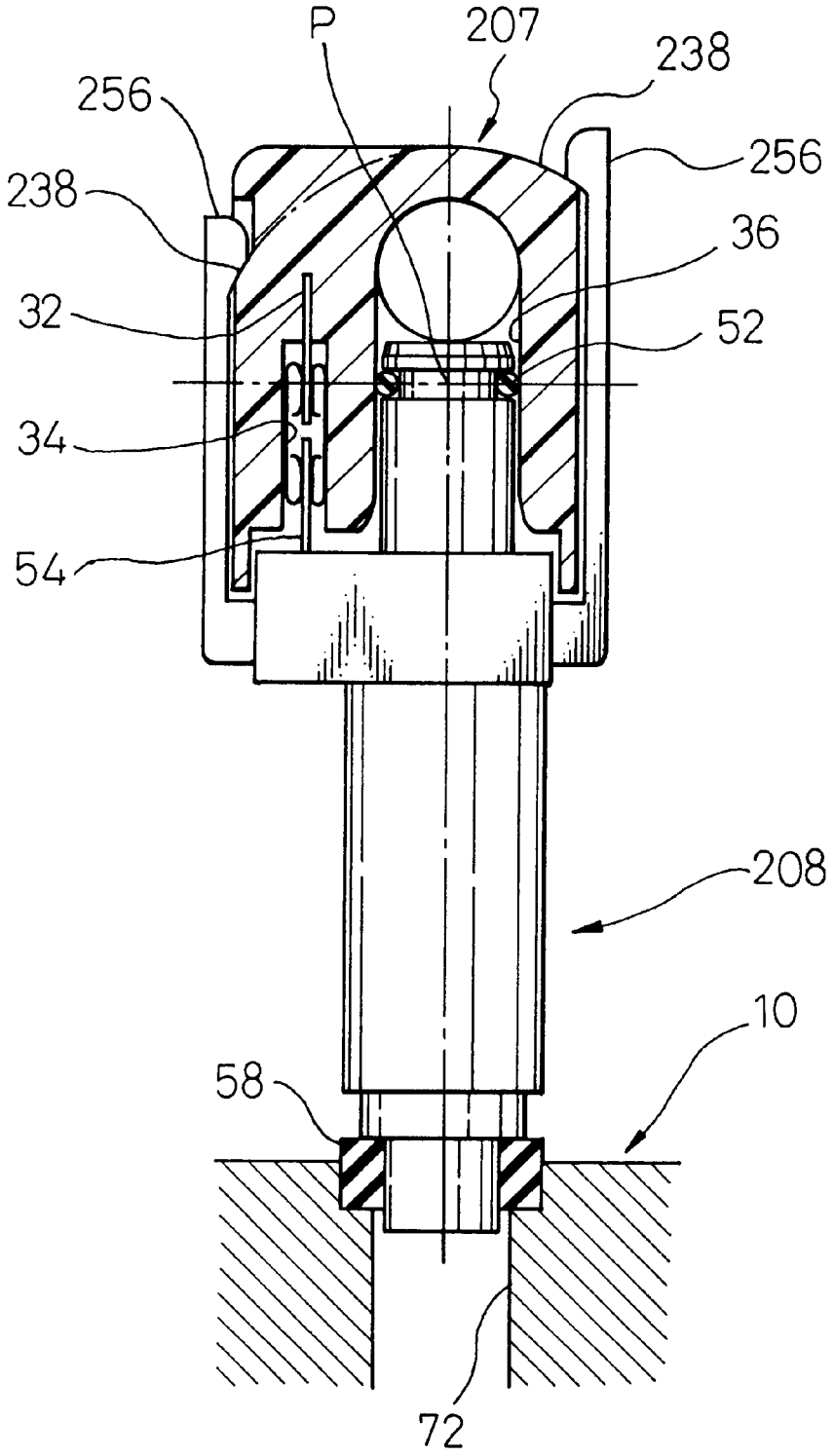
FIG. 5 is an enlarged partial sectional view of a delivery pipe and an injector of a second embodiment according to the present invention, similar to FIG. 3.

FIG. 5 shows an enlarged partial sectional view of a delivery pipe and an injector of a second embodiment according to the present invention, similar to FIG. 3. In FIG. 5, a reference numeral 207 shows the delivery pipe. A reference numeral 208 shows the injector. A reference numeral 238 shows a fixing hook sliding surface. A reference numeral 256 shows a fixing hook which slides along the fixing hook sliding surface 238. Parts which are the same as the parts in the first embodiment, are shown with reference numerals which are the same as the reference numerals in the first embodiment, and will not be explained below.

While fuel is injected, the injector 208 is forced downward by fuel pressure. However, the injector 208 is prevented from moving with respect to the delivery pipe 207 in the direction of an axis of the injector, because the lower faces of the fixing hooks 256 contact the fixing hook sliding surfaces 238. Therefore, the slide of an electrically contacting point between the connector 34 and the injector side terminal 54 is prevented, and an increase in electric resistance, caused by the wear of the electrically contacting point, is prevented.

Figure 6:
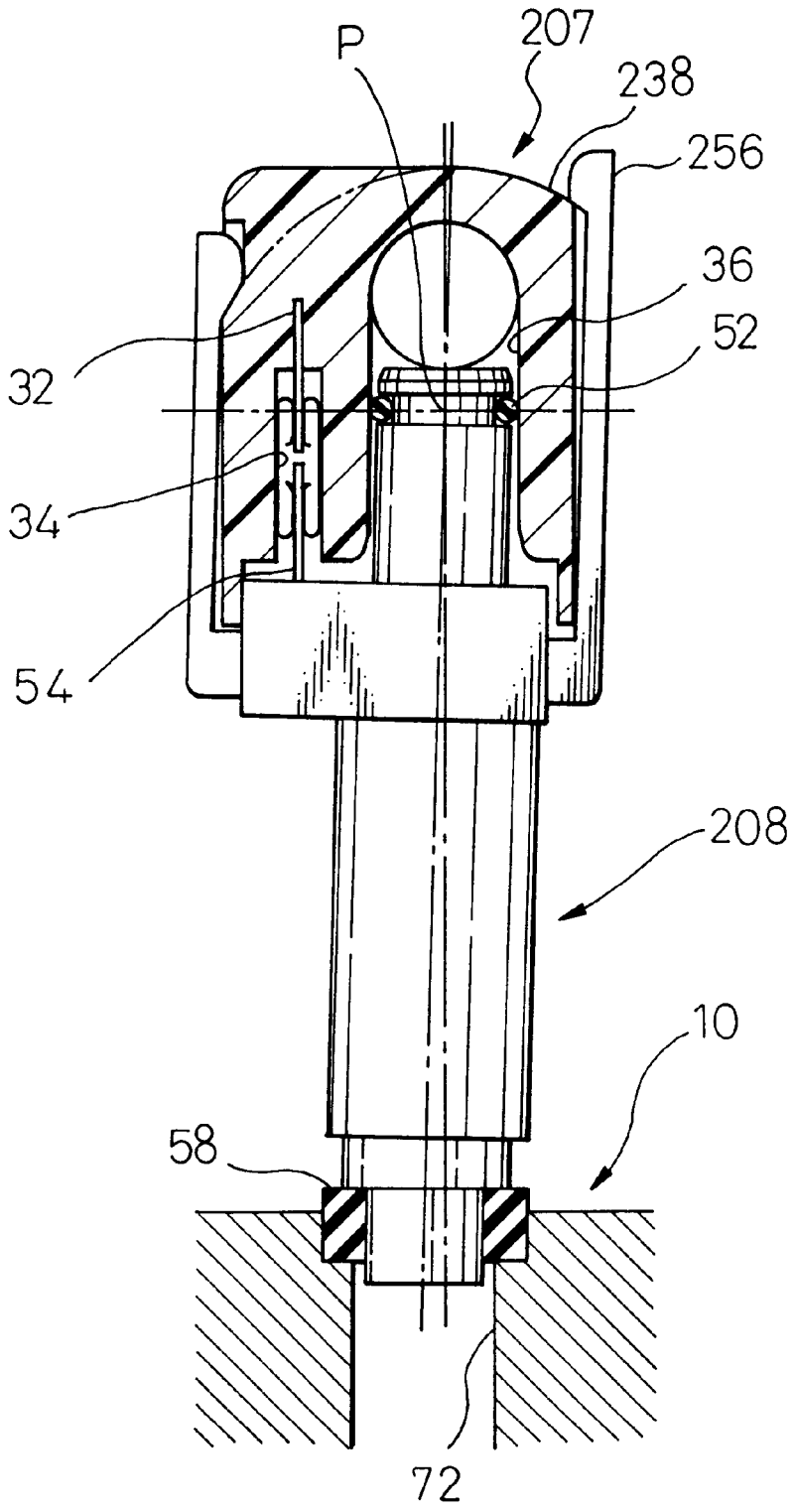
FIG. 6 is an enlarged partial sectional view of the delivery pipe and the injector of the second embodiment, wherein the injector is inclined with respect to the delivery pipe.

Further, as shown with a dashed line in FIG. 5, the fixing hook sliding surfaces 238 are spherical and have a center, the center of the fixing hook sliding surfaces corresponding to the center P of the O-ring 52. The fixing hooks 256 slide along the fixing hook sliding surface 238. Therefore, the injector 208 can rotate with respect to the delivery pipe 207 around the center P of the O-ring 52. FIG. 6 shows an enlarged partial sectional view of the delivery pipe and the injector of the second embodiment, wherein the injector 208 is rotated around the center P, i.e., the injector 208 is inclined with respect to the delivery pipe 207.

When the pitch of the injector mounting holes 36 and the pitch of the injector inserting holes 72 are not the same, or when an axis of the injector mounting hole 36 is inclined with respect to an axis of the injector inserting hole 72 even if the pitch of the injector mounting holes 36 and the pitch of the injector inserting holes 72 are the same, the injector 208 is inclined with respect to the axis of the injector mounting hole 36 and is mounted in the injector mounting hole 36. However, since the injector 208 rotates around the center P of the O-ring, the O-ring 52 is prevented from being biased, and the contacting area between the O-ring 52 and the injector mounting hole 36 decreases less. This means that a decrease of sealing efficiency of fuel between the delivery pipe 207 and the injector 208 can be prevented.

Figure 7:
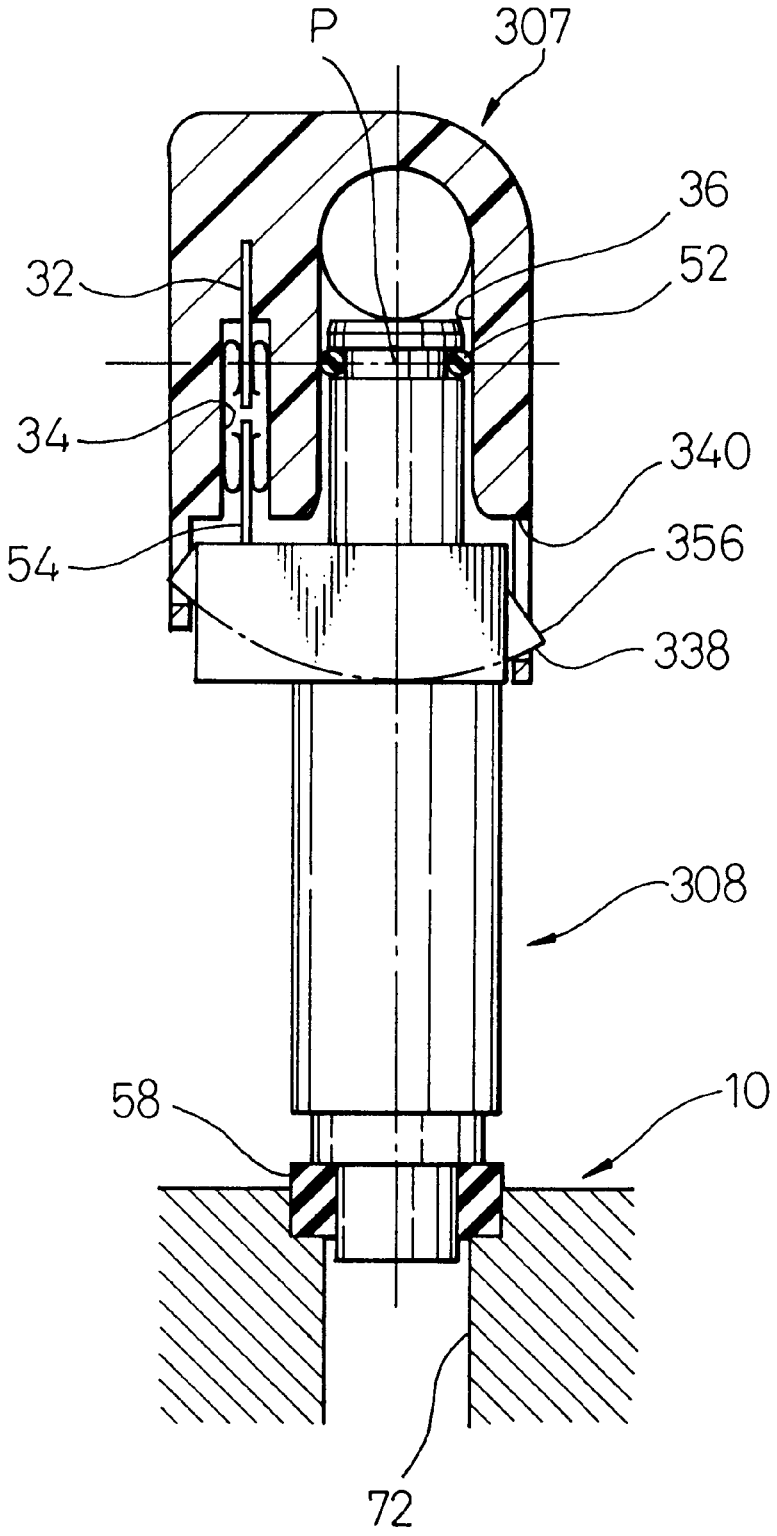
FIG. 7 is an enlarged partial sectional view of a delivery pipe and an injector of a third embodiment according to the present invention, similar to FIG. 3.

FIG. 7 shows an enlarged partial sectional view of a delivery pipe and an injector of a third embodiment according to the present invention, similar to FIG. 3. In FIG. 7, a reference numeral 307 shows the delivery pipe. A reference numeral 308 shows the injector. A reference numeral 338 shows a fixing hook sliding surface which is spherical and has a center, the center of the fixing hook sliding surface corresponding to the center P of the O-ring 52. A reference numeral 356 shows a fixing hook which has the fixing hook sliding surface 338. A reference numeral 340 shows a fixing hook groove. Parts which are the same as the parts in the first embodiment, are shown with reference numerals which are the same as the reference numerals in the first embodiment, and will not be explained below.

While fuel is injected, the injector 308 is forced downward by fuel pressure. However, the injector 308 is prevented from moving with respect to the delivery pipe 307 in the direction of an axis of the injector, because the fixing hook sliding surfaces 338 of the fixing hooks 356 contact lower faces of the fixing hook grooves 340. Therefore, the sliding of an electrically contacting point between the connector 34 and the injector side terminal 54 is prevented, and an increase of electric resistance, caused by the wear of the electrically contacting point, is prevented.

Figure 8:
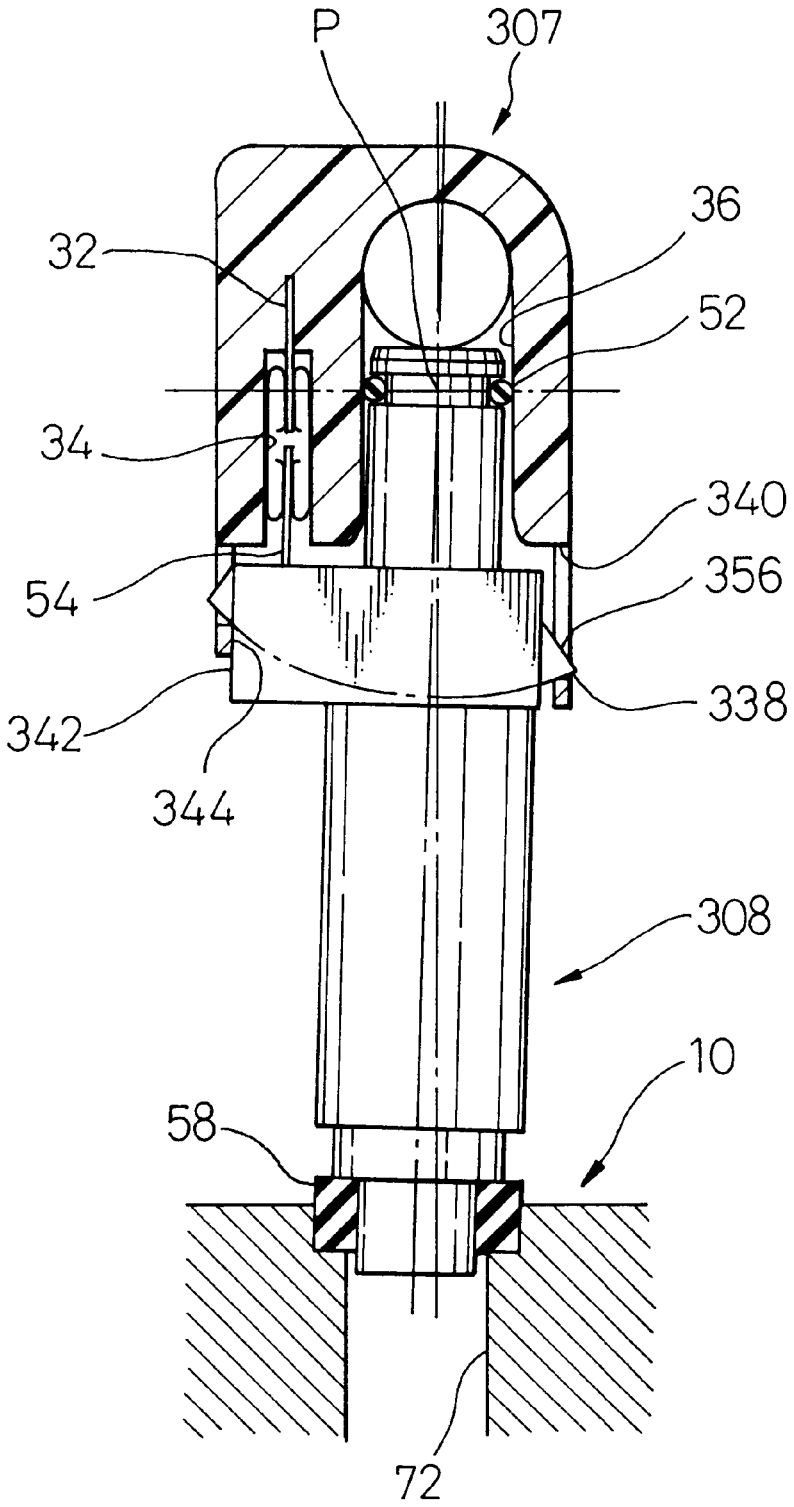
FIG. 8 is an enlarged partial sectional view of the delivery pipe and the injector of the third embodiment, wherein the injector is inclined with respect to the delivery pipe.

Further, as shown in FIG. 7 and as explained above, the fixing hook sliding surfaces 338 are spherical and have the center, the center of the fixing hook sliding surfaces corresponding to the center P of the O-ring 52. Moreover, the fixing hooks 356 are supported by the lower faces of the fixing hook grooves 340 at two points whereat the fixing hook sliding surfaces 338 contact the lower faces of the fixing hook grooves 340. When the injector 308 rotates with respect to the delivery pipe 307, the fixing hooks 356 rotate while the lower faces of the fixing hook grooves 340 contact the fixing hook sliding surfaces 356 at two points. Therefore, the injector 308 can rotate with respect to the delivery pipe 307 around the center P of the O-ring 52. FIG. 8 shows an enlarged partial sectional view of the delivery pipe and the injector of the third embodiment, wherein the injector 308 is rotated around the center P, i.e., the injector 308 is inclined with respect to the delivery pipe 307.

When the pitch of the injector mounting holes 36 and the pitch of the injector inserting holes 72 are not the same, or when an axis of the injector mounting hole 36 is inclined with respect to an axis of the injector inserting hole 72 even if the pitch of the injector mounting holes 36 and the pitch of the injector inserting holes 72 are the same, the injector 308 is inclined with respect to the axis of the injector mounting hole 36 and is mounted in the injector mounting hole 36. However, since the injector 308 rotates around the center P of the O-ring, the O-ring 52 is prevented from being biased, and the contacting area between the O-ring 52 and the injector mounting hole 36 decreases less. This means that a decrease of sealing efficiency of fuel between the delivery pipe 307 and the injector 308 can be prevented. Further, when distance between the fixing hook 356 and the intake manifold 10 is smaller than distance between the O-ring 52 and the intake manifold 10, the length of the injector 308 is decreased.

Figure 9:
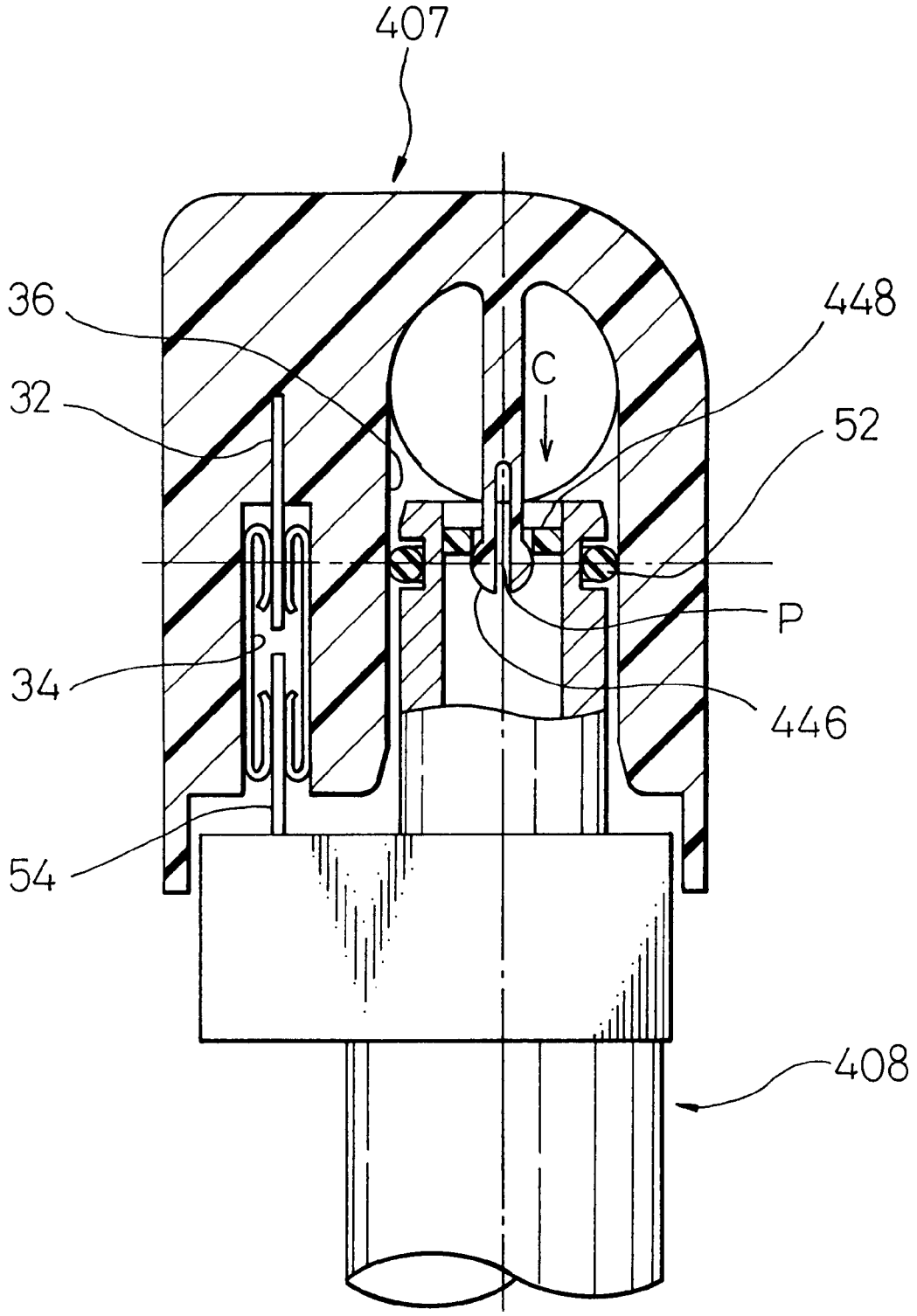
FIG. 9 is an enlarged partial sectional view of a delivery pipe and an injector around an O-ring of a fourth embodiment according to the present invention.

FIG. 9 shows an enlarged partial sectional view of a delivery pipe and an injector around an O-ring of a fourth embodiment according to the present invention. In FIG. 9, a reference numeral 407 shows the delivery pipe. A reference numeral 408 shows the injector. A reference numeral 446 shows a fixing hook male portion integrally molded in the delivery pipe 407. A reference numeral 448 shows a fixing hook female portion which is pressed into the injector 407 for housing the fixing hook male portion 446. Parts which are the same as the parts in the first embodiment, are shown with reference numerals which are the same as the reference numerals in the first embodiment, and will not be explained below.

While fuel is injected, the injector 408 is forced downward by fuel pressure. However, the injector 408 is prevented from moving with respect to the delivery pipe 407 in the direction of an axis of the injector, because an upper face of the fixing hook male portion 446 contacts a lower face of the fixing hook female portion 448. Therefore, the sliding of an electrically contacting point between the connector 34 and the injector side terminal 54 is prevented, and the increase of electric resistance caused by the wear of the electrically contacting point is prevented.

Figure 10:
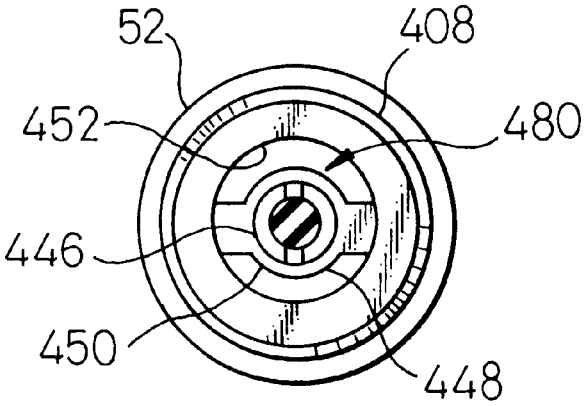
FIG. 10 is a top view of the injector, a fixing hook male portion and a fixing hook female portion, viewed in a direction C in FIG. 9.

Further, as shown in FIG. 9, a tip of the fixing hook male portion 446 is spherical and has a center, the center of the fixing hook male portion corresponding to the center P of the O-ring 52. Therefore, the injector 408 can rotate with respect to the delivery pipe 407 around the center P of the O-ring 52. FIG. 10 shows a top view of the injector, the fixing hook male portion and the fixing hook female portion, viewed in a direction C in FIG. 9. In FIG. 10, a gap 480 is provided between an outer wall 450 of the fixing hook female portion 448 and an inner wall 452 of the injector 408. Therefore, fuel delivered from the delivery pipe 407 can pass the gap 480 and move into the injector 408.

When the pitch of the injector mounting holes 36 and the pitch of the injector inserting holes 72 are not the same, or when an axis of the injector mounting hole 36 is inclined with respect to an axis of the injector inserting hole 72 even if the pitch of the injector mounting holes 36 and the pitch of the injector inserting holes 72 are the same, the injector 408 is inclined with respect to the axis of the injector mounting hole 36 and is mounted in the injector mounting hole 36. However, since the injector 408 rotates around the center P of the O-ring, the O-ring 52 is prevented from being biased, and the contacting area between the O-ring 52 and the injector mounting hole 36 decreases less. This means that a decrease of sealing efficiency of fuel between the delivery pipe 407 and the injector 408 can be prevented.

Figure 11:
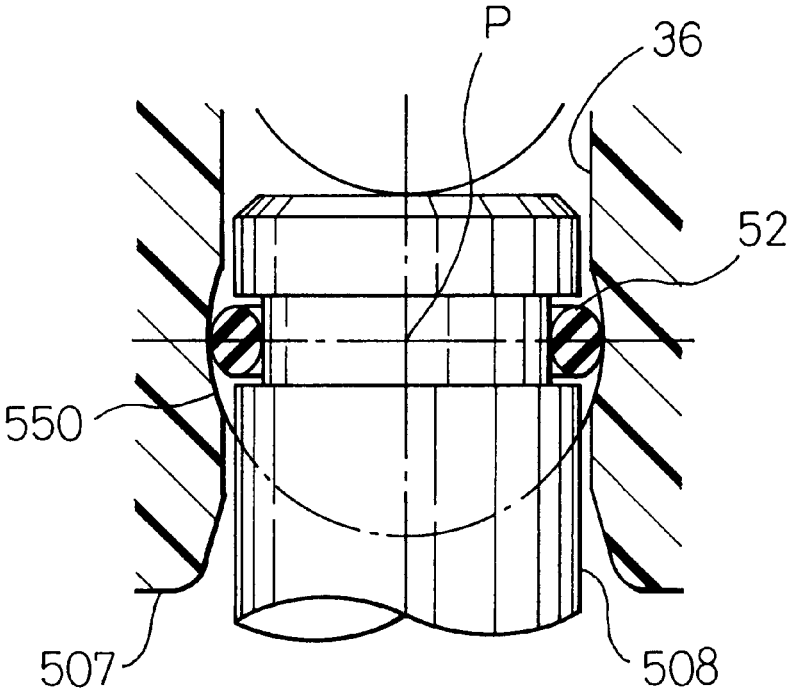
FIG. 11 is an enlarged partial sectional view of a delivery pipe and an injector around an O-ring of a fifth embodiment according to the present invention.

FIG. 11 shows an enlarged partial sectional view of a delivery pipe and an injector around an O-ring of a fifth embodiment according to the present invention. In FIG. 11, a reference numeral 507 shows the delivery pipe. A reference numeral 508 shows the injector. A reference numeral 550 shows a sealing surface which has a spherical concave portion and a center, the center of the sealing surface corresponding to the center P of the O-ring. The sealing surface 550 contacts the O-ring 52. Parts which are the same as the parts in the first embodiment, are shown with reference numerals which are the same as the reference numerals in the first embodiment, and will not be explained below.

While fuel is injected, the injector 508 is forced downward by fuel pressure. However, since the injector 508 is prevented from moving with respect to the delivery pipe 507 in the direction of the axis of the injector, the sliding of an electrically contacting point between the connector 34 and the injector side terminal 54 is prevented, and the increase of electric resistance caused by the wear of the electrically contacting point is prevented.

Further, as shown in FIG. 11 and as explained above, the sealing surface 550 has the spherical concave portion the center of which corresponds to the center P of the O-ring. Therefore, the O-ring 52 can slide and rotate along the sealing surface 550, and the injector 508 can rotate with respect to the delivery pipe 507 around the center P of the O-ring 52.

When the pitch of the injector mounting holes 36 and the pitch of the injector inserting holes 72 are not the same, or when an axis of the injector mounting hole 36 is inclined with respect to an axis of the injector inserting hole 72 even if the pitch of the injector mounting holes 36 and the pitch of the injector inserting holes 72 are the same, the injector 508 is inclined with respect to the axis of the injector mounting hole 36 and is mounted in the injector mounting hole 36. However, since the injector 508 rotates around the center P of the O-ring, the O-ring 52 is prevented from being biased, and contacting area between the O-ring 52 and the injector mounting hole 36 decreases less. This means that a decrease of sealing efficiency of fuel between the delivery pipe 507 and the injector 508 can be prevented.

Figure 12:
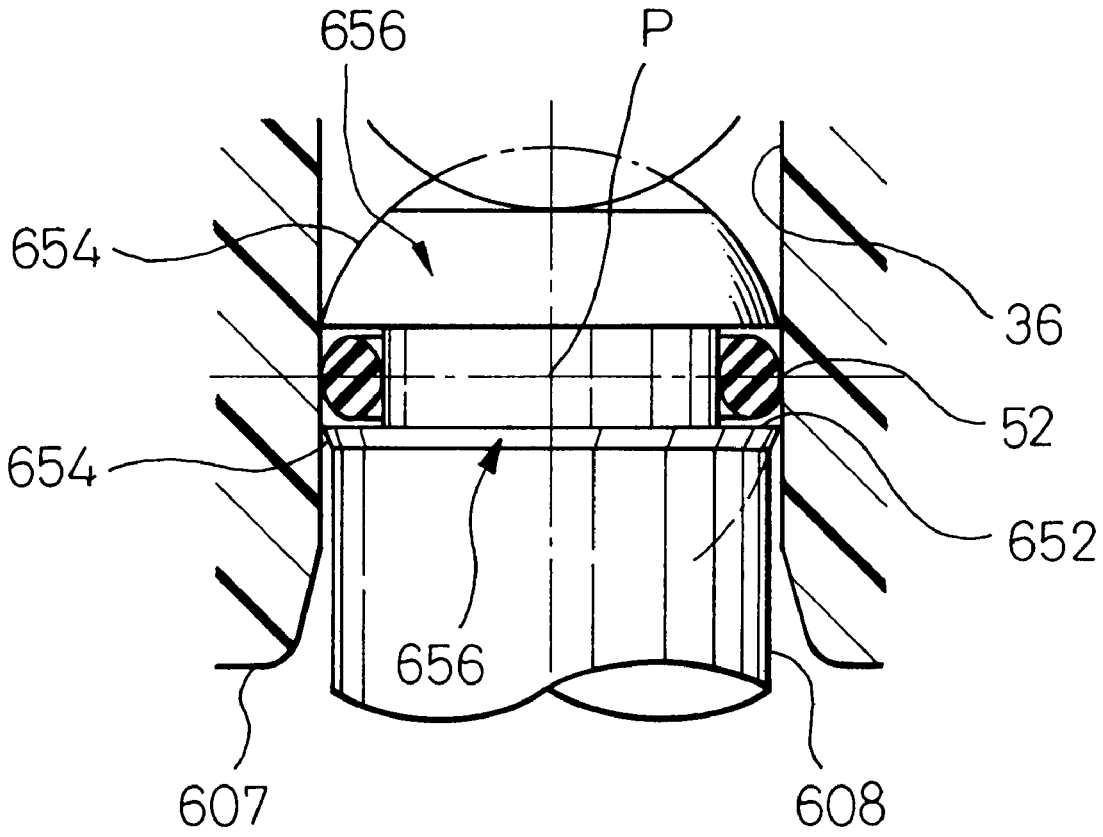
FIG. 12 is an enlarged partial sectional view of a delivery pipe and an injector around an O-ring of a sixth embodiment according to the present invention.

FIG. 12 shows an enlarged partial sectional view of a delivery pipe and an injector around an O-ring of a sixth embodiment according to the present invention. In FIG. 12, a reference numeral 607 shows the delivery pipe. A reference numeral 608 shows the injector. A reference numeral 652 shows an O-ring groove, in which the O-ring 52 is mounted. A reference numeral 654 shows a spherical guide portion which has a center corresponding to the center P of the O-ring 52. The guide portion 654 prevents the O-ring 52 from being biased. A reference numeral 656 shows an adjacent portion which adjoins the O-ring groove 652 and has the guide portion 654. Parts which are the same as the parts in the first embodiment, are shown with reference numerals which are the same as the reference numerals in the first embodiment, and will not be explained below.

While fuel is injected, the injector 608 is forced downward by fuel pressure. However, since the injector 608 is prevented from moving with respect to the delivery pipe 607 in the direction of an axis of the injector, the sliding of an electrically contacting point between the connector 34 and the injector side terminal 54 is prevented, and the increase of electric resistance caused by the wear of the electrically contacting point is prevented.

Further, as shown in FIG. 12, the O-ring 52 can slide along an inner wall of the injector mounting hole 36 and can rotate around the center P of the O-ring 52. Therefore, the injector 608 can rotate with respect to the delivery pipe 607 around the center P of the O-ring 52. Moreover, as explained above, the injector 608 has the adjacent portion 656 adjoining the O-ring groove 652, and the adjacent portion 656 has the spherical guide portion 654 whose center corresponds to the center P of the O-ring 52. Therefore, the guide portion 654 prevents the O-ring 52 from being biased, and the injector 608 can rotate with respect to the delivery pipe 607 around the center P of the O-ring 52.

When the pitch of the injector mounting holes 36 and the pitch of the injector inserting holes 72 are not the same, or when an axis of the injector mounting hole 36 is inclined with respect to an axis of the injector inserting hole 72 even if the pitch of the injector mounting holes 36 and the pitch of the injector inserting holes 72 are the same, the injector 608 is inclined with respect to the axis of the injector mounting hole 36 and is mounted in the injector mounting hole 36. However, since the injector 608 rotates around the center P of the O-ring, the O-ring 52 is prevented from being biased, and contacting area between the O-ring 52 and the injector mounting hole 36 decreases less. This means that a decrease of sealing efficiency of fuel between the delivery pipe 607 and the injector 608 can be prevented.

Figure 13:
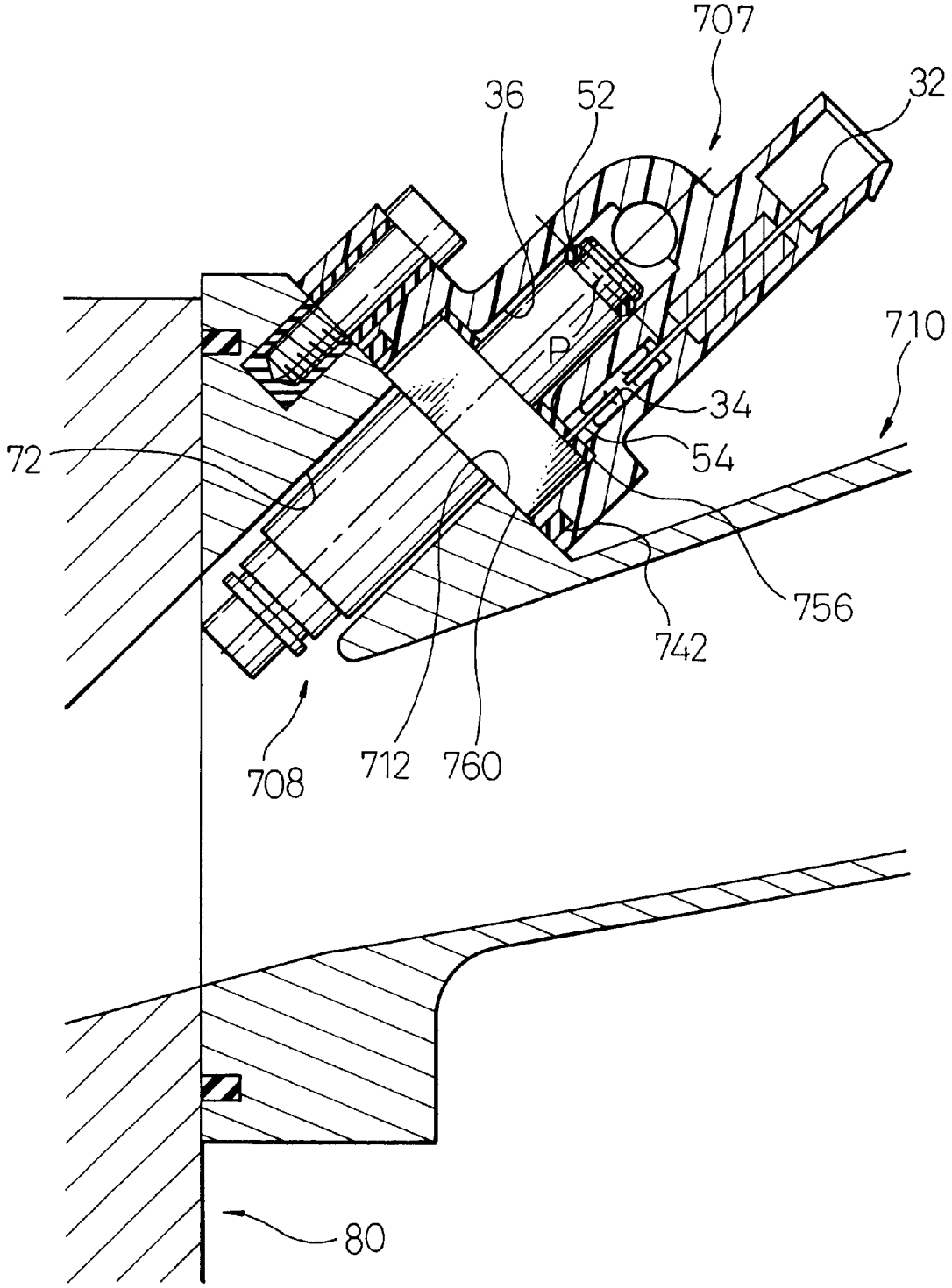
FIG. 13 is an enlarged partial sectional view of a delivery pipe, an injector and an intake manifold of a seventh embodiment according to the present invention.

FIG. 13 shows an enlarged partial sectional view of a delivery pipe, an injector and an intake manifold of a seventh embodiment according to the present invention. In FIG. 13, a reference numeral 707 shows the delivery pipe. A reference numeral 708 shows the injector. A reference numeral 710 shows the intake manifold. A reference numeral 760 shows a contact surface provided on the injector 708. A reference numeral 712 shows a support surface contacting the contact surface 708 and provided on the intake manifold 710. A reference numeral 756 shows a connector waterproof packing for preventing water from leaking in the connector 34, the connector waterproof packing being mounted between the delivery pipe 707 and the injector 708. A reference numeral 742 shows a sealing member mounted between the delivery pipe 707 and the intake manifold 710. A reference numeral 80 shows a cylinder head. As shown in FIG. 13, the delivery pipe 707 is immovably fixed to the intake manifold 710 by means of a securing member. Parts which are the same as the parts in the first embodiment, are shown with reference numerals which are the same as the reference numerals in the first embodiment, and will not be explained below.

While fuel is injected, the injector 708 is forced by fuel pressure toward the lower left side in FIG. 13. However, the injector 708 is prevented from moving with respect to the delivery pipe 707 in the direction of an axis of the injector, because the support surface 712 on the intake manifold 710 contacts the contact surface 760 on the injector 708. Therefore, the sliding of an electrically contacting point between the connector 34 and the injector side terminal 54 is prevented, and an increase of electric resistance, caused by the wear of the electrically contacting point, is prevented.

Further, as shown in FIG. 13, an inclination of the injector 708 with respect to the delivery pipe 707 in a diametrical direction is restricted by two points, i.e., by means of only the O-ring 52 and the connector waterproof packing 756 respectively mounted between the delivery pipe 707 and the injector 708.

When the injector 708 is inclined with respect to the delivery pipe 707 in the diametrical direction and is mounted to the delivery pipe 707, the injector 708 rotates around the center P of the O-ring 52. Therefore, the O-ring 52 is prevented from being biased, and contacting area between the O-ring 52 and the injector mounting hole 36 decreases less. This means that a decrease of sealing efficiency of fuel between the delivery pipe 707 and the injector 708 can be prevented.

Figure 15:
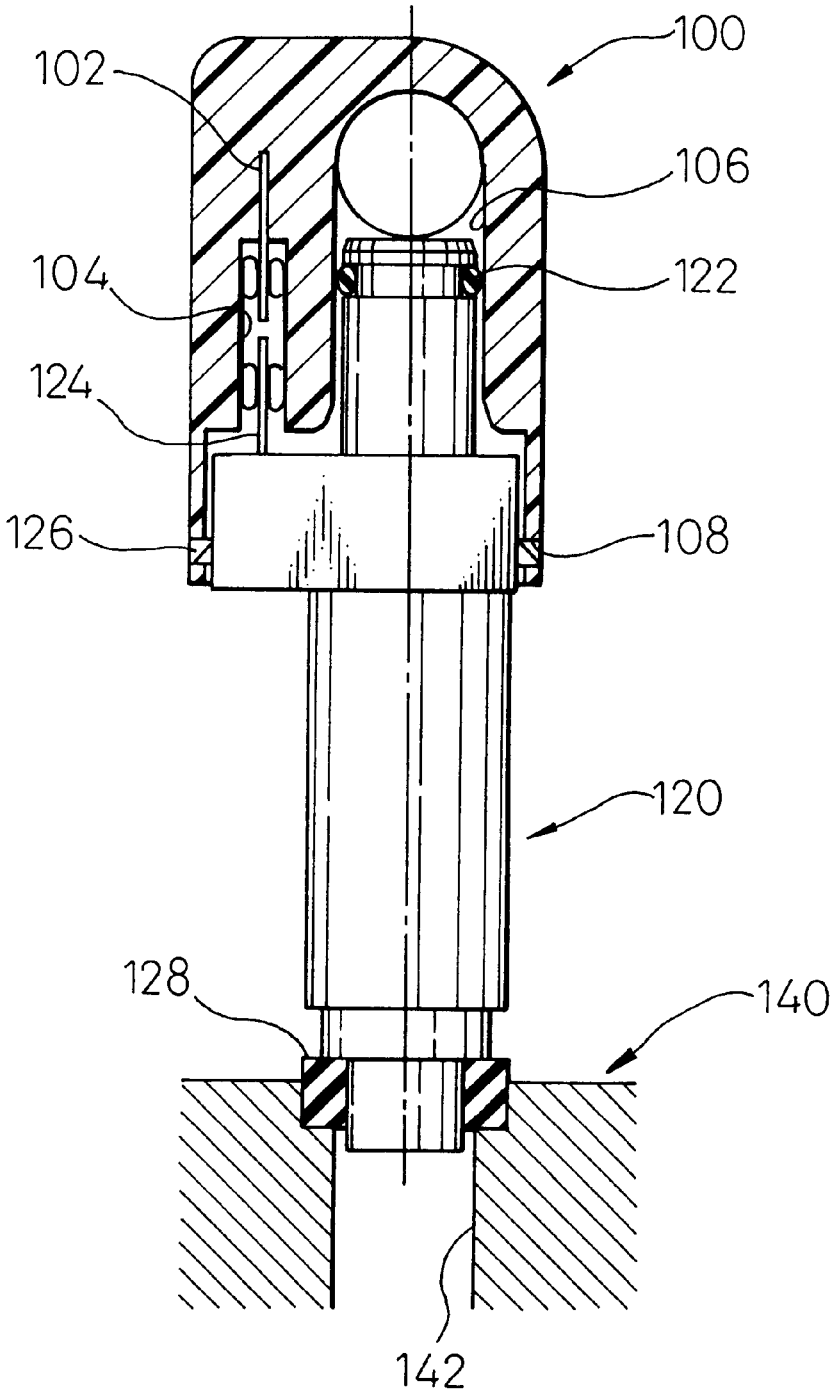
Fig.15 PRIOR ART
FIG. 15 is an enlarged partial sectional view of a delivery pipe and an injector of a fuel injection apparatus of the prior art.
Figure 16:
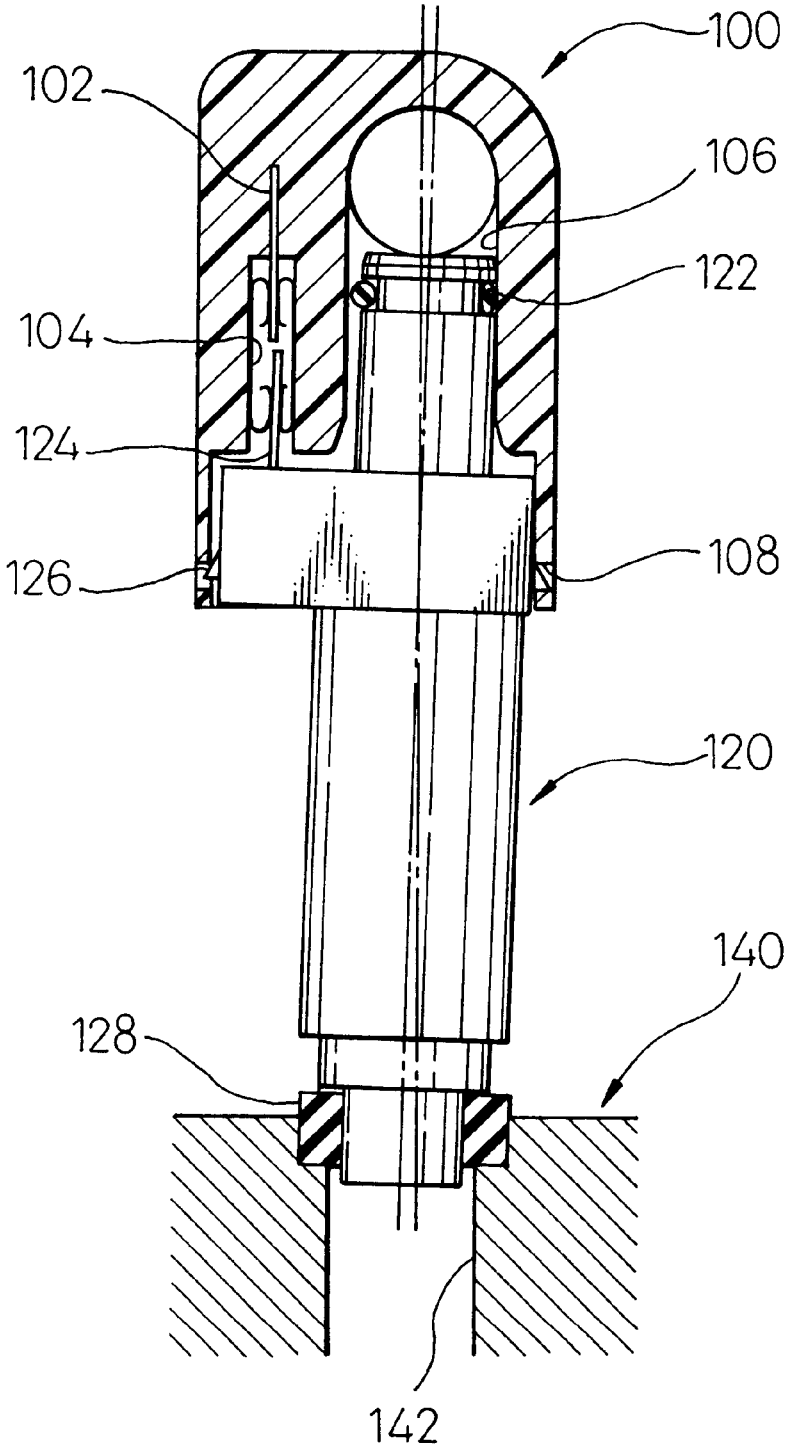
Fig.16 PRIOR ART
FIG. 16 is an enlarged partial sectional view similar to FIG. 15, wherein the injector is inclined with respect to an axis of an injector mounting hole and is mounted in the injector mounting hole.

As explained above, the inclination of the injector 708 with respect to the delivery pipe 707 in the diametrical direction is determined by only the delivery pipe 707 and the injector 708. Therefore, the injector 708 is positioned with respect to the delivery pipe 707 regardless of the dimensional accuracy of the injector inserting hole 72 in the intake manifold 710. Further, since a lower tip of the injector 708 does not contact the intake manifold 710 or the cylinder head 80, bad effect on the basis of heat decreases. Since the whole injector 8 is covered with the delivery pipe 707 and the intake manifold 710, the operational noise of the injector 708 is insulated. Moreover, since the injector 708 is prevented from moving with respect to the delivery pipe 707 in the direction of an axis of the injector by means of the contact surface 760 of the injector 708 and the support surface 712 of the intake manifold 710, the fuel injection apparatus of the embodiment does not need the fixing hook 126 shown in FIG. 15.

The sealing member 742 is mounted between the delivery pipe 707 and the intake manifold 710, and therefore, a gap between the delivery pipe 707 and the intake manifold 710 can be certainly sealed.

Figure 14:
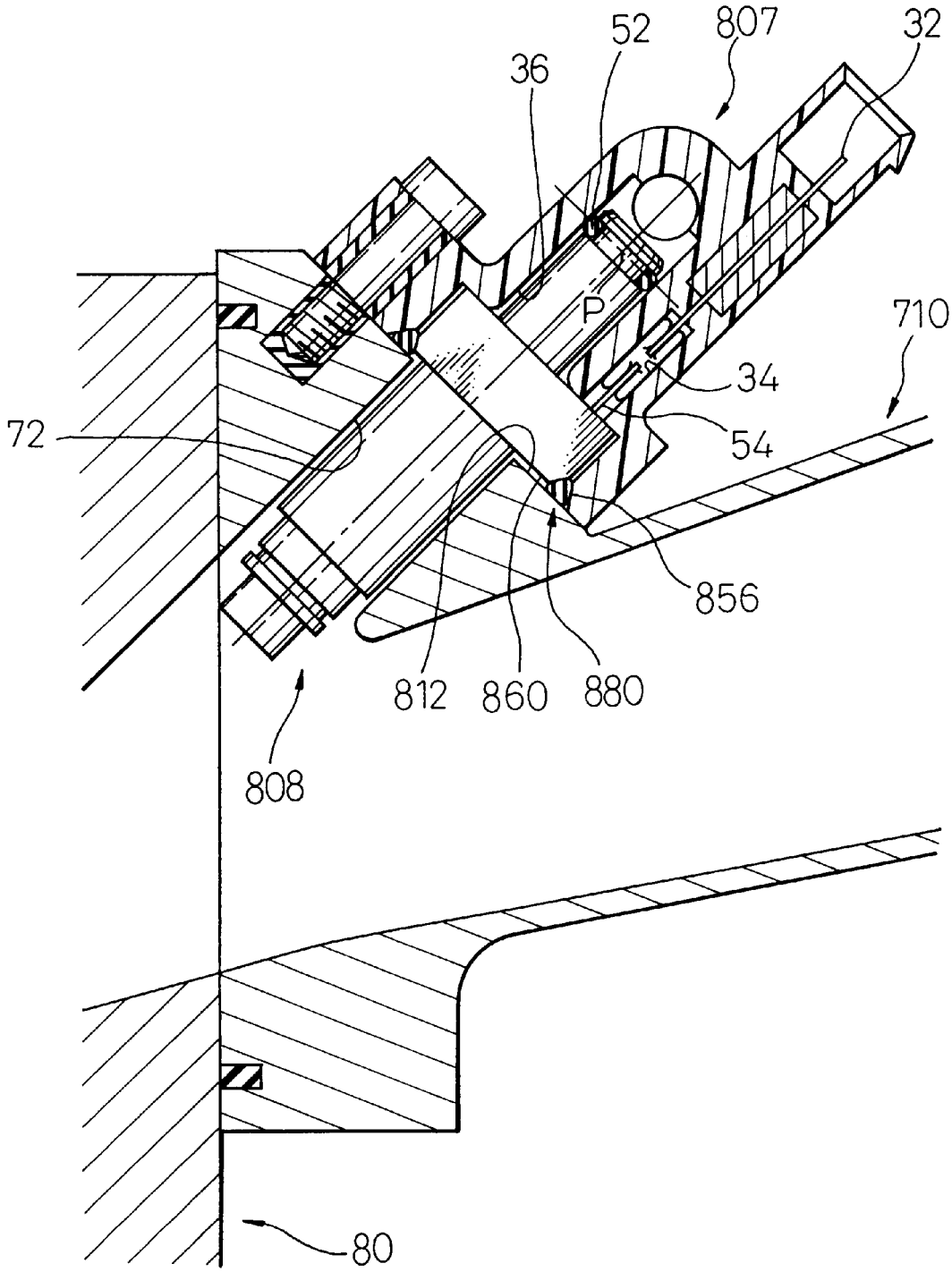
FIG. 14 is an enlarged partial sectional view of a delivery pipe, an injector and an intake manifold of an eighth embodiment according to the present invention, similar to FIG. 13.

FIG. 14 shows an enlarged partial sectional view of a delivery pipe, an injector and an intake manifold of a eighth embodiment according to the present invention, similar to FIG. 13. In FIG. 14, a reference numeral 807 shows the delivery pipe. A reference numeral 808 shows the injector. A reference numeral 710 shows the intake manifold. A reference numeral 860 shows a contact surface provided on the injector 808. A reference numeral 812 shows a support surface contacting the contact surface 808 and provided on the intake manifold 810. A reference numeral 856 shows a connector waterproof packing for preventing water from leaking in the connector 34, the connector waterproof packing being positioned at a boundary 880 between the delivery pipe 807, the injector 808 and the intake manifold 710. A reference numeral 80 shows a cylinder head. As shown in FIG. 14, the delivery pipe 807 is unmovably fixed to the intake manifold 710 by means of a securing member. Parts which are the same as the parts in the first embodiment are shown with reference numerals which are the same as the reference numerals in the first embodiment, and will not be explained below.

While fuel is injected, the injector 808 is forced by fuel pressure toward the lower left side in FIG. 14. However, the injector 808 is prevented from moving with respect to the delivery pipe 807 in the direction of an axis of the injector, because the support surface 812 on the intake manifold 710 contacts the contact surface 860 on the injector 808. Therefore, the sliding of an electrically contacting point between the connector 34 and the injector side terminal 54 is prevented, and the increase of electric resistance caused by the wear of the electrically contacting point is prevented.

Further, as shown in FIG. 14, an inclination of the injector 808 with respect to the delivery pipe 807 in a diametrical direction is restricted by two points, i.e., by means of only the O-ring 52 mounted between the delivery pipe 807 and the injector 808, and the connector waterproof packing 856 mounted between the delivery pipe 807, the injector 808 and the intake manifold 710.

When the injector 808 is inclined with respect to the delivery pipe 807 in the diametrical direction and is mounted to the delivery pipe 807, the injector 808 rotates around the center P of the O-ring 52. Therefore, the O-ring 52 is prevented from being biased, and contacting area between the O-ring 52 and the injector mounting hole 36 decreases less. This means that the decrease of sealing efficiency of fuel between the delivery pipe 807 and the injector 808 can be prevented.

Further, since the connector waterproof packing 856 is positioned at the boundary 880 between the delivery pipe 807, the injector 808 and the intake manifold 710, the connector waterproof packing 856 can achieve function which is the same as function of the connector waterproof packing 756 and the sealing member 742 shown in FIG. 13.

Although the delivery pipe 707 is mounted to the intake manifold 710 in the seventh embodiment, and the delivery pipe 807 is mounted to the intake manifold 710 in the eighth embodiment, the delivery pipe can be directly mounted to the cylinder head 80, for achieving advantageous effect which is the same as the advantageous effect in the seventh and eighth embodiments.

While the above description constitutes the preferred embodiment of the present invention, it will be appreciated that the invention is susceptible to modification, variation and change without departing from the proper scope and fair meaning of the accompanying claims.

What is claimed is:

1. A fuel injection apparatus comprising:

a delivery pipe having an electric signal line and a connector, the connector being placed at an end of the electric signal line;

an injector having an axis, an O-ring and an injector side terminal and mounted to the delivery pipe, the O-ring having a center and sealing a gap between the delivery pipe and the injector, the injector side terminal being electrically connected with the connector;

a fixing member for preventing the injector side terminal from sliding with respect to the connector in a direction of the axis of the injector; and the fixing member having a plurality of fixing points, the plurality of fixing points being positioned on a line, the line passing through the center of the O-ring and being perpendicular to the axis of the injector.

2. A fuel injection apparatus comprising:

a delivery pipe having an electric signal line and a connector, the connector being placed at an end of the electric signal line;

an injector having an axis, an O-ring and an injector side terminal and mounted to the delivery pipe, the O-ring having a center and sealing a gap between the delivery pipe and the injector, the injector side terminal being electrically connected with the connector;

a fixing member for preventing the injector side terminal from sliding with respect to the connector in a direction of the axis of the injector; and the fixing member having a sliding surface between the delivery pipe and the injector, the sliding surface being spherical and having a center, the center of the sliding surface corresponding to the center of the O-ring.

3. A fuel injection apparatus comprising:

a delivery pipe having an electric signal line and a connector, the connector being placed at an end of the electric signal line;

an injector having an axis, an O-ring and an injector side terminal and mounted to the delivery pipe, the O-ring having a center and sealing a gap between the delivery pipe and the injector, the injector side terminal being electrically connected with the connector;

a fixing member for preventing the injector side terminal from sliding with respect to the connector in a direction of the axis of the injector; and the fixing member being positioned on the center of the O-ring.

4. A fuel injection apparatus comprising:

a delivery pipe having an electric signal line and a connector, the connector being placed at an end of the electric signal line;

an injector having an axis, an O-ring and an injector side terminal and mounted to the delivery pipe, the O-ring having a center and sealing a gap between the delivery pipe and the injector, the injector side terminal being electrically connected with the connector;

a fixing member for preventing the injector side terminal from sliding with respect to the connector in a direction of the axis of the injector; and the delivery pipe having a sealing surface between the delivery pipe and the O-ring, the sealing surface being spherical and having a center, the center of the sealing surface corresponding to the center of the O-ring.

5. A fuel injection apparatus comprising:

a delivery pipe having an electric signal line and a connector, the connector being placed at an end of the electric signal line;

an injector having an axis, an O-ring and an injector side terminal and mounted to the delivery pipe, the O-ring having a center and sealing a gap between the delivery pipe and the injector, the injector side terminal being electrically connected with the connector;

a fixing member for preventing the injector side terminal from sliding with respect to the connector in a direction of the axis of the injector; and the injector having an O-ring groove and an adjacent portion, the O-ring being mounted in the O-ring groove, the adjacent portion adjoining the O-ring groove and having a guide portion, the guide portion being spherical and having a center, the center of the guide portion corresponding to the center of the O-ring.

6. A fuel injection apparatus comprising:

a delivery pipe having an electric signal line and a connector, the connector being placed at an end of the electric signal line;

an injector having an axis, an O-ring and an injector side terminal and mounted to the delivery pipe, the O-ring having a center and sealing a gap between the delivery pipe and the injector, the injector side terminal being electrically connected with the connector;

an engine side member, the delivery pipe and the injector being mounted to the engine side member;

a connector waterproof packing for preventing water from leaking in the connector, the connector waterproof packing being provided between the delivery pipe and the injector;

a fixing member for preventing the injector side terminal from sliding with respect to the connector in a direction of the axis of the injector;

the fixing member having a contact surface and a support surface, the contact surface being a portion of the injector, the support surface being a portion of the engine side member and contacting the contact surface;

the inclination of the injector with respect to the delivery pipe in a diametrical direction being restricted only by means of the connector waterproof packing and the O-ring.

7. A fuel injection apparatus according to claim 6, wherein the fixing member includes the connector waterproof packing, the connector waterproof packing being positioned at a boundary between the injector, the delivery pipe and the engine side member.

* * * * *